US005232576A

United States Patent [19]

Matsumoto et al.

[11] Patent Number: 5,232,576

[45] Date of Patent: Aug. 3, 1993

[54] ANODE FOR CHROMIUM PLATING AND PROCESSES FOR PRODUCING AND USING THE SAME

[75] Inventors: Yukiei Matsumoto; Masao Sekimoto, both of Kanagawa, Japan

[73] Assignee: Permelec Electrode Ltd., Kanagawa, Japan

[21] Appl. No.: 755,423

[22] Filed: Sep. 4, 1991

[30] Foreign Application Priority Data

Sep. 4, 1990 [JP] Japan ..... 2-234137

[51] Int. Cl.[5] ..... C25D 17/10; C25D 3/04; B05D 5/12

[52] U.S. Cl. ..... 205/284; 204/290 F; 427/125; 427/126.5

[58] Field of Search ..... 204/290 F, 242; 205/284; 427/126.5, 125

[56] References Cited

U.S. PATENT DOCUMENTS 3,882,002 5/1975 Cook, Jr. ..... 204/290 F
4,581,117 4/1986 Asano et al. ..... 204/290 F

OTHER PUBLICATIONS

Chemical Abstract 95: 51800e, Aug. 10, 1981.
Chemical Abstract 101: 179898c, Nov. 12, 1989.
Chemical Abstract 108: 121032u, Apr. 4, 1988.
Chemical Abstract 111: 242636q, Dec. 25, 1989.

*Primary Examiner*—John Niebling
*Assistant Examiner*—Brian M. Bolam
*Attorney, Agent, or Firm*—Sughrue, Mion, Zinn, Macpeak & Seas

[57] ABSTRACT

There are described an anode, a process for producing the same, an apparatus for electrolytic chromium plating, and a method for electrolytic chromium plating, using such anode, wherein the anode comprises an electrically conductive substrate comprising a valve metal or an alloy thereof, a first intermediate layer formed on the sustrate and comprising an oxide of tin, a second intermediate layer formed on the first intermediate layer and comprising either (1) platinum metal and an oxide of tin, or (2) platinum metal, an oxide of tin, and iridium oxide, and a surface layer formed on the second intermediate layer and comprising either (1) platinum metal and an oxide of tin, or (2) platinum metal, an oxide of tin, and iridium oxide, the composition of said surface layer being different form that of said second intermediate layer.

8 Claims, No Drawings

ANODE FOR CHROMIUM PLATING AND PROCESSES FOR PRODUCING AND USING THE SAME

FIELD OF THE INVENTION

The present invention relates to an anode for chromium plating, particularly an anode suitable for use in chromium-plating bath containing additives of organic materials, and also relates to a process for producing the anode.

BACKGROUND OF THE INVENTION

Conventionally, lead or lead-alloy electrodes have mainly been used as the anode for chromium plating. Although the lead or lead-alloy electrodes satisfactorily function to oxidize trivalent chromium ions formed on the cathode to hexavalent chromic acid, its chemical and electrochemical corrosion resistance is so poor that lead dissolves into the chromium-plating bath to form insoluble lead chromate or lead sulfate, which accumulates as sludge in the plating tank. In order to remove the sludge, the plating operation is suspended.

As a substitute for the lead or lead-alloy electrode, an anode comprising a substrate made of a valve metal such as titanium, and, formed on the substrate, a covering layer containing a platinum group metal or an oxide thereof, is coming to be used.

However, such an electrode obtained by covering a substrate made of titanium or other valve metal with a layer containing a platinum group metal or an oxide thereof has disadvantages as described below, although use of this electrode as an anode for chromium plating is free from the sludge formation accompanying the use of lead or lead-alloy electrodes. Disadvantages include that the above electrode is costly, and, further more, there is a problem that since the electrode is insufficient in ability to anodize trivalent chromium ions resulting from reduction of chromic acid on the cathode during plating into hexavalent chromic acid on the anode, the concentration of trivalent chromium ions in the plating bath increases, and, as a result, the plating bath weakens chromium deposit-covering power. Also, there are cases where sufficiently glossy deposits cannot be obtained. In addition, the electrical conductivity of the plating bath decreases, making it difficult to conduct the chromium plating normally.

Recently, chromium-plating baths containing various kinds of additives of organic materials, such as sulfonic acid-based baths, have been developed as substitutes for the conventional Sargent bath and hydrosilicofluoric acid baths having considerable corrosive properties, and have come into common use. Compared to the conventional Sargent bath, the chromium-plating bath containing an additive of an organic material has attained a higher cathode current efficiency and improved plating efficiency, and also has an advantage that chromium-plated products produced using this plating bath have improved quality.

Such a chromium-plating bath containing an additive of an organic material, however, has a problem in that if a lead or lead-alloy electrode is used as an anode in this plating bath, the electrode is consumed more rapidly than the same electrode in the conventional Sargent bath; hence, such use involves a problem.

A platinum-plated electrode obtained by covering a substrate made of a valve metal such as titanium with platinum by electroplating is also being used as an anode in plating baths, as an alternative to the lead or lead-alloy electrode. Although this platinum-plated electrode has a high electrode potential and is excellent in the ability to anodize trivalent chromium ions formed by cathodic reduction into hexavalent chromic acid on the anode, it is defective in that since the chromium-plating bath contains an organic material, the platinum is consumed at a high rate, and, hence, the thickness of the platinum deposit covering the substrate should be increased in order to maintain long-term and stable chromium plating. This raises the cost of the electrode. Therefore, the cost advantage brought about by the replacement of the conventional Sargent bath with the chromium-plating baths containing organic ingredients is diminished.

On the other hand, as an expedient for improving the corrosion resistance of an electrode obtained by covering a substrate made of a valve metal or an alloy thereof with an electrode catalyst coating containing a platinum group metal or an oxide thereof, provision of an intermediate layer made of a composite oxide of stannic oxide and antimony oxide between the electrode catalyst coating and the electrode substrate is disclosed, for example, in JP-B-59-2753 and JP-B-61-36075 (the term "JP-B" as used herein means an "examined Japanese patent publication"). However, any of such intermediate layers is unable to be stably present in chromium-plating baths and dissolves away within a short time period. For this reason, the above intermediate layer is ineffective in preventing the deterioration of the substrate and cannot retain its adhesion to the electrode catalyst coating layer containing a platinum group metal or an oxide thereof and, as a result, the voltage increases in a short period of time.

In addition, the electrodes having a catalyst coating comprising a platinum group metal or an oxide thereof, for example, the electrode as described in JP-B-59-2753 which has a ruthenium oxide coating, have been unable to stand practical use because they show poor corrosion resistance when used as an anode for plating, and, furthermore, their ability to oxidize trivalent chromium ions into hexavalent chromic acid is poor.

JP-B-62-2038 discloses an electrode which comprises a substrate made of a valve metal or an alloy thereof, having formed thereon an electrode catalyst coating containing a mixture of a platinum group metal and tin dioxide, and the consumption of which is reduced due to such a coating. This electrode, however, is unsuitable for chromium plating because when chromium plating is conducted using this electrode as the anode, oxygen evolved during the electrolysis increases the voltage in a short time period, making the electrode unusable any more.

SUMMARY OF THE INVENTION

The present inventors have conducted extensive studies to eliminate the above-described problems. As a result, they have succeeded in developing an anode for chromium plating which has the ability to sufficiently oxidize trivalent chromium to hexavalent chromic acid, and which also has good corrosion resistance.

That is, the present inventors have made studies with a view to reducing the consumed amount of platinum for the platinum-plated electrode excellent in the ability to anodize trivalent chromium ions into hexavalent chromic acid and having a high oxygen-evolving potential, and as a result, it has been found that the consumption of platinum in chromium-plating baths containing additives of organic materials can be reduced without impairing the properties originally possessed by the platinum-plated electrode, by employing a platinum layer in which a specific substance has been dispersed and by providing intermediate layers having specific compositions.

An object of the present invention is to provide an anode for chromium plating which is particularly suitable for use in plating baths containing additives of organic materials.

Another object of the present invention is to provide a process for producing the above anode.

Still another object of the present invention is to provide an electrolytic chromium-plating method employing the above anode.

A still further object of the present invention is to provide an apparatus for carrying out electrolytic chromium-plating, said apparatus using an anode of the type described above.

The anode for chromium plating according to the present invention comprises an electrically conductive substrate comprising a valve metal or an alloy thereof, a first intermediate layer formed on the substrate and comprising an oxide of tin, a second intermediate layer formed on the first intermediate layer and comprising either (1) platinum metal and an oxide of tin, or (2) platinum metal, an oxide of tin, and iridium oxide, and a surface layer formed on the second intermediate layer and comprising either (1) platinum metal and an oxide of tin, or (2) platinum metal, an oxide of tin, and iridium oxide, the composition of the surface layer being different from that of the second intermediate layer.

In another aspect, the present invention relates to a method for producing an anode in accordance with the present invention as described above.

In still another embodiment of the present invention, there is provided a method for electrolytic chromium plating which comprises conducting electrolytic chromium plating using an anode of the present invention as described above.

According to a still further embodiment of the present invention, an apparatus for chromium plating is provided, comprising an anode which comprises an electrically conductive substrate comprising a valve metal or an alloy thereof, a first intermediate layer formed on the substrate and comprising an oxide of tin, a second intermediate layer formed on the first intermediate layer and comprising either (1) platinum metal and an oxide of tin, or (2]platinum metal, an oxide of tin, and iridium oxide, and a surface layer formed on the second intermediate layer and comprising either (1) platinum metal and an oxide of tin, or (2) platinum metal, an oxide of tin, and iridium oxide, the composition of said surface layer being different from that of said second intermediate layer.

DETAILED DESCRIPTION OF THE INVENTION

The anode for chromium plating according to the present invention is characterized as having an electrode catalyst coating comprising platinum and an oxide of tin dispersed in the platinum. Although the electrode catalyst coating contains an oxide of tin, the ability of platinum to anodize trivalent chromium ions into hexavalent chromic acid can be fully maintained because the tin oxide itself is low in electrochemical catalytic activity, and hence has little influence on the platinum electrode.

It is also possible, according to the present invention, to further diminish the consumption of platinum by dispersing iridium oxide, along with the tin oxide, into the platinum.

In producing the anode of the present invention, the electrode catalyst coating comprising these components is formed on a substrate made of a valve metal such as titanium, tantalum, niobium, zirconium, hafnium, or an alloy thereof. However, since direct covering of the substrate with the electrode catalyst coating results in insufficient electrode performance, the coating is formed on the substrate not directly but through the medium of intermediate layers. That is, before the electrode catalyst coating is formed, a first intermediate layer comprising an oxide of tin is formed by coating the substrate with a solution containing a tin compound and then heat-treating the coating in an oxidizing atmosphere, and, furthermore, a second intermediate layer containing an oxide of tin and platinum metal is formed on the first intermediate layer.

The first intermediate layer serves mainly to improve the adhesion of an electrode catalyst coating to the substrate and increase the electrical conductivity between the coating and the substrate. Preferable effects can be obtained when the amount of the tin oxide fixed on the electrode substrate is from 0.5 $g/m^2$ to 30 $g/m^2$. A more preferred range of the tin oxide amount is from 0.5 $g/m^2$ to 10 $g/m^2$. Amounts of the tin oxide covering the substrate exceeding 30 $g/m^2$ are not preferable because such amounts lead to an increase in electrode potential.

On the first intermediate layer, a second intermediate layer comprising platinum metal and an oxide of tin is formed by coating the first intermediate layer with a solution containing a platinum compound and a tin compound, and then heat-treating the coating in an oxidizing atmosphere. This second intermediate layer may further contain iridium oxide as the third component in addition to the two components, platinum metal and tin oxide. Such a three-component covering layer can be formed by coating a solution containing a platinum compound, a tin compound, and an iridium compound, and then heat-treating the coating in an oxidizing atmosphere.

In the case where the second intermediate layer is constituted by two components, i.e., platinum metal and tin oxide, the proportion of the former to the latter component is preferably from 30:70 to 60:40 by mol. Part of the platinum contained in an amount in the above-specified range may be replaced with iridium oxide in an amount so as to result in an iridium oxido content of 10 mol % or less based on the total amount of the platinum metal, tin oxide, and iridium oxide.

If the content of iridium oxide in the second intermediate layer exceeds 10 mol %, an oxygen-evolving reaction takes place on the second intermediate layer because of the significantly high electrochemical activity of iridium oxide as compared with platinum metal, and, as a result, the electrode potential rises disadvantageously in a short period of time.

The second intermediate layer is exceedingly effective in improving the adhesion of an electrode catalyst coating as a surface layer to the first intermediate layer and the electrical conductivity between the two layers.

On the second intermediate layer, a surface layer which comprises platinum metal and an oxide of tin and may further contain iridium oxide is formed by coating the second intermediate layer with a solution which contains a platinum compound and a tin compound and may further contain an iridium compound and in which the relative amounts of the ingredients are different from those for the second intermediate layer, and then heat-treating the coating in an oxidizing atmosphere.

In the case where the surface layer is constituted by two components, i.e., platinum metal and tin oxide, the proportion of the former to the latter component is preferably from 70:30 to 90:10 by mol. Part of the platinum the relative amount of which to the tin oxide is in the above-specified range may be replaced with iridium oxide in an amount so as to result in an iridium oxide content of 10 mol % or less based on the total amount of the platinum, tin oxide, and iridium oxide, thereby to form a three-component surface covering layer.

If the platinum content in the surface layer is below 70 mol %, electrode potential increases in a short period of time. If the platinum content is above 90 mol %, the platinum is consumed at an increased rate. Further, if iridium oxide is incorporated in an amount exceeding 10 mol %, the ability of electrode to anodize trivalent chromium ions formed by cathodic reduction into hexavalent chromium-based chromic acid is weakened because iridium oxide has a low oxygen-evolving potential. For this reason, iridium contents exceeding 10 mol % are not preferred.

In order to obtain the desired thickness for each covering layer of the electrode, the coating and heat-treatment operations as described hereinabove may be conducted repeatedly.

The anode for chromium plating according to the present invention, which comprises an electrically conductive substrate comprising a valve metal or an alloy thereof, a first intermediate layer formed on the substrate and comprising an oxide of tin, a second intermediate layer formed on the first intermediate layer and comprising either platinum metal and an oxide of tin or platinum metal, an oxide of tin, and iridium oxide, and a surface layer formed on the second intermediate layer and comprising either platinum metal and an oxide of tin or platinum metal, an oxide of tin, and iridium oxide, and in which the composition of the surface layer is different from that of the second intermediate layer, shows exceedingly good corrosion resistance, particularly when it is used in chromium-plating baths containing additives of organic materials.

The present invention is explained in more detail by reference to the following examples, which should not be construed as limiting the scope of the invention.

EXAMPLE 1

Using stannic chloride, platinum chloride, and iridium chloride as raw materials for electrode coating ingredients, various solutions for forming first intermediate layers, second intermediate layers, and surface layers were prepared by dissolving these compounds in hydrochloric acid.

The first intermediate layer-forming coating solution was coated by brushing it on a titanium plate cleaned with hot oxalic acid, and the coating was dried and then heat-treated at 550° C. in an oxidizing atmosphere. The above procedure of coating, drying, and heat treatment was repeated to form a first intermediate layer having a desired thickness on the titanium substrate.

Subsequently, a second intermediate layer and a surface layer were formed on the first intermediate layer using a second intermediate layer-forming solution and a surface layer-forming solution, respectively, in substantially the same manner as that for the first intermediate layer. Likewise, a total of eight kinds of electrodes were prepared in each of which the first intermediate layer, second intermediate layer, and surface layer had respective compositions as shown in Table 1.

TABLE 1

| Electrode No. | Fixed $SnO_2$ amount in the first intermediate layer ($g/m^2$) | Molar ratio of Pt:Sn:Ir in the second intermediate layer | Molar ratio Pt:Sn:Ir in the surface layer |
|---|---|---|---|
| 1 | 0.5 | 30:70:0 | 90:10:0 |
| 2 | 5 | 25:70:5 | 65:30:5 |
| 3 | 30 | 40:60:0 | 78:20:2 |
| 4 | 20 | 38:60:2 | 70:30:0 |
| 5 | 5 | 50:50:0 | 74:20:6 |
| 6 | 20 | 49:50:1 | 80:10:10 |
| 7 | 10 | 60:40:0 | 80:20:0 |
| 8 | 10 | 50:40:10 | 63:30:7 |

Using each of the thus-obtained electrodes of the present invention, which were different in coating layer composition, as an anode, and using a copper plate as a cathode, continuous electrolysis was conducted at 60° C. in a chromium-plating bath containing 40 ml/l of organic type additive MI-40 (manufactured by Canning Co., U. K.) at an anode current density of 30 $A/dm^2$.

The time period in which the anode potential rose by 1 V from its initial value at the beginning of the electrolysis was measured for each anode and taken as lifetime. As a result, the anodes were found to have lifetimes of 2,000 hours or more.

COMPARATIVE EXAMPLE 1

In the same manner as in Example 1, electrode Nos. 9 to were prepared which were the same as those prepared in Example 1, except that they differed from the electrodes of Example 1 in fixed tin oxide amount for the first intermediate layer and in the composition of the second intermediate layer and surface layer. The compositions of the first intermediate layer, second intermediate layer, and surface layer are shown in Table 2.

TABLE 2

| Electrode No. | Fixed $SnO_2$ amount in the first intermediate layer ($g/m^2$) | Molar ratio of Pt:Sn:Ir in the second intermediate layer | Molar ratio Pt:Sn:Ir in the surface layer |
|---|---|---|---|
| 9 | 0 | 30:70:0 | 90:10:0 |
| 10 | 0.5 | 20:80:0 | 80:20:0 |
| 11 | 0.5 | 70:30:0 | 80:20:0 |
| 12 | 0.5 | 43:40:17 | 80:20:0 |
| 13 | 0.5 | 15:70:15 | 80:20:0 |
| 14 | 0.5 | 40:60:0 | 100:0:0 |
| 15 | 0.5 | 40:60:0 | 60:40:0 |
| 16 | 0.5 | 40:60:0 | 72:10:18 |
| 17 | 0.5 | 40:60:0 | 56:30:14 |
| 18 | 40 | 40:60:0 | 80:20:0 |

Using each of the thus-obtained electrodes as an anode for chromium plating, electrolysis was conducted under the same conditions as in Example 1. As a result, the lifetimes of electrode Nos. 9 to 14 were 1,000 hours or less, while those of electrode Nos. 15 to 18 were between 1,000 hours and 2,000

EXAMPLE 2

Electrode Nos. 19 to 26 were prepared under the same conditions as in electrode Nos. 1 to 8 of Example 1. Using each of the thus-obtained electrodes as an anode and using a copper plate as a cathode, 100-hour continuous electrolysis was conducted in the same chromium-plating bath as in Example 1 at an anode current density and cathode current density of 30 A/dm$^2$. After completion of each electrolysis, the concentration of trivalent chromium ions in the resulting chromium plating bath was measured by redox titration. The results obtained are shown in Table 3, from which it is seen that the trivalent chromium ion concentration for each electrolysis was so low that the chromium plating was never impeded by the chromium ions.

TABLE 3

| Electrode No. | Fixed $SnO_2$ amount in the first intermediate layer (g/m$^2$) | Molar ratio of Pt:Sn:Ir in the second intermediate layer | Molar ratio of Pt:Sn:Ir in the surface layer | Trivalent chromium ion concentration (g/l) |
|---|---|---|---|---|
| 19 | 0.5 | 30:70:0 | 90:10:0 | 2.9 |
| 20 | 5 | 25:70:5 | 65:30:5 | 3.2 |
| 21 | 30 | 40:60:0 | 78:20:2 | 3.0 |
| 22 | 20 | 38:60:2 | 70:30:0 | 3.5 |
| 23 | 5 | 50:50:0 | 74:20:6 | 3.6 |
| 24 | 20 | 49:50:1 | 80:10:10 | 3.3 |
| 25 | 10 | 60:40:0 | 80:20:0 | 3.3 |
| 26 | 10 | 50:40:10 | 63:30:7 | 3.7 |

COMPARATIVE EXAMPLE 2

Electrode Nos. 27 and 28 were prepared under the same conditions as in electrodes of Example 1 except that the molar proportion Of iridium oxide in the surface layer was increased. Electrolysis was conducted and the concentration of trivalent chromium ions in the resulting plating bath was then measured under the same conditions as in Example 2. The results obtained are shown in Table 4, from which it is seen that the trivalent chromium ion concentrations were unfavorably high for chromium plating.

TABLE 4

| Electrode No. | Fixed $SnO_2$ amount in the first intermediate layer (g/m$^2$) | Molar ratio of Pt:Sn:Ir in the second intermediate layer | Molar ratio of Pt:Sn:Ir in the surface layer | Trivalent chromium ion concentration (g/l) |
|---|---|---|---|---|
| 27 | 0.5 | 40:60:0 | 72:10:18 | 13.4 |
| 28 | 0.5 | 40:60:0 | 56:30:14 | 16.2 |

As described above, the anode for chromium plating according to the present invention, which comprises an electrically conductive substrate comprising a valve metal or an alloy thereof, a first intermediate layer formed on the substrate and comprising an oxide of tin, a second intermediate layer formed on the first intermediate layer and comprising either platinum metal and an oxide of tin or platinum metal, an oxide of tin, and iridium oxide, and a surface layer formed on the second intermediate layer and comprising either platinum metal and an oxide of tin or platinum metal, an oxide of tin, and iridium oxide, and in which the composition of the surface layer is different from that of the second intermediate layer, shows excellent durability when used in organic ingredient-containing plating baths that are advantageous in providing chromium deposits having excellent properties, so that the consumption of the anode can be one-tenth to one-twentieth as large as that of conventional platinum-plated electrodes and the anode enables chromium plating to be conducted stably over a prolonged period of time.

While the invention has been described in detail and with reference to specific embodiments thereof, it will be apparent to one skilled in the art that various changes and modifications can be made therein without departing from the spirit and scope thereof.

What is claimed is:

1. An anode for chromium plating which comprises an electrically conductive substrate comprising a valve metal or an alloy thereof, a first intermediate layer formed on the substrate and comprising an oxide of tin, a second intermediate layer formed on the first intermediate layer and comprising either (1) platinum metal and an oxide of tin, or (2) platinum metal, an oxide of tin, and iridium oxide, and a surface layer formed on the second intermediate layer and comprising either (1) platinum metal and an oxide of tin, or (2) platinum metal, an oxide of tin, and iridium oxide, the composition of said surface layer being different from that of said second intermediate layer.

2. An anode as in claim 1, wherein the amount of the tin oxide fixed on the substrate in said first intermediate layer is from 0.5 g/m$^2$ to 30 g/m$^2$.

3. An anode as in claim 1, wherein the amount of the tin oxide fixed on the substrate in said first intermediate layer is from 0.5 g/m$^2$ to 10 g/m$^2$.

4. An anode as in claim 1, wherein in said second intermediate layer, the proportion of at least either of platinum and iridium oxide to tin oxide is from 30:70 to 60:40 by mol and the content of iridium oxide is 10 mol % or less.

5. An anode as in claim 1, wherein in said surface layer, the proportion of at least either of platinum and iridium oxide to tin oxide is from 70:30 to 90:10 by mol and the content of iridium oxide is 10 mol % or less.

6. A process for producing an anode for chromium plating which comprises coating a solution containing a tin compound on a substrate comprising a valve metal or an alloy thereof, heat-treating the coating in an oxidizing atmosphere to form a first intermediate layer comprising an oxide of tin, coating the first intermediate layer with a second intermediate layer-forming coating solution containing either (1) a platinum compound and a tin compound, or (2) a platinum compound, a tin compound, and an iridium compound, heat-treating the second intermediate layer coating in an oxidizing atmosphere to form a second intermediate layer comprising either (1) platinum metal and an oxide of tin, or (2) platinum metal, an oxide of tin, and iridium oxide, subsequently coating the second intermediate layer with a surface layer-forming coating solution containing either (1) a platinum compound and a tin compound, or (2) a platinum compound, a tin compound, and an iridium compound, and different in ingredient composition from the second intermediate layer, and then heat-treating the surface layer coating in an oxidizing atmosphere to form a surface layer comprising either (1) platinum metal and an oxide of tin, or (2) platinum metal, an oxide of tin, and iridium oxide.

7. A method of electrolytic chromium plating which comprises conducting electrolytic chromium plating using an anode comprising an electrically conductive substrate comprising a valve metal or an alloy thereof, a first intermediate layer formed on the substrate and comprising an oxide of tin, a second intermediate layer formed on the first intermediate layer and comprising either (1) platinum metal and an oxide of tin, or (2) platinum metal, an oxide of tin, and iridium oxide, and a surface layer formed on the second intermediate layer and comprising either (1) platinum metal and an oxide of tin, or (2) platinum metal, an oxide of tin, and iridium oxide, the composition of said surface layer being different from that of said second intermediate layer.

8. An apparatus for electrolytic chromium plating including an anode which comprises an electrically conductive substrate comprising a valve metal or an alloy thereof, a first intermediate layer formed on the substrate and comprising an oxide of tin, a second intermediate layer formed on the first intermediate layer and comprising either (1) platinum metal and an oxide of tin, or (2) platinum metal, an oxide of tin, and iridium oxide, and a surface layer formed on the second intermediate layer and comprising either (1) platinum metal and an oxide of tin, or (2) platinum metal, an oxide of tin, and iridium oxide, the composition of said surface layer being different form that of said second intermediate layer.

* * * * *